United States Patent [19]

Terzian

[11] 4,356,663

[45] Nov. 2, 1982

[54] CRYING DOLL

[75] Inventor: Rouben T. Terzian, Chicago, Ill.

[73] Assignee: Marvin Glass & Associates, Chicago, Ill.

[21] Appl. No.: 119,823

[22] Filed: Feb. 8, 1980

[51] Int. Cl.[3] ..... A63H 3/24

[52] U.S. Cl. ..... 46/118; 46/135 A; 46/141

[58] Field of Search ..... 46/135 A, 141, 118

[56] References Cited

U.S. PATENT DOCUMENTS

| | | | |
|---|---|---|---|
| 2,196,912 | 4/1940 | Gilbraith | 46/141 |
| 2,934,856 | 5/1960 | Cohn | 46/141 X |
| 2,954,640 | 10/1960 | Catalano et al. | 46/141 X |
| 2,959,890 | 11/1960 | Ostrander | 46/135 A |
| 2,978,833 | 4/1961 | Tancredi | 46/141 X |
| 3,419,994 | 1/1969 | Glass et al. | 46/118 |
| 3,473,260 | 10/1969 | Kripak et al. | 46/118 X |
| 3,769,745 | 11/1973 | Crosman | 46/135 A |
| 4,050,185 | 9/1977 | Terzian | 46/135 A |
| 4,124,952 | 11/1978 | Terzian | 46/141 X |

FOREIGN PATENT DOCUMENTS

| | | | |
|---|---|---|---|
| 1111267 | 10/1955 | France | 46/135 A |
| 380960 | 9/1932 | United Kingdom | 46/141 |

*Primary Examiner*—F. Barry Shay

*Attorney, Agent, or Firm*—Mason, Kolehmainen, Rathburn & Wyss

[57] ABSTRACT

An animated crying doll includes a hollow head, a hollow body connected at the neck and the head is formed with a face having a pair of eyes and a mouth defined therein. A liquid bladder is mounted in the head having a flexible wall and conduits in communication between the bladder and openings formed in the eyes for conducting liquid from the bladder to the surface of the eyes to resemble crying or tearing. Means is provided for forcing the liquid from the bladder through the conduits to the eyes and at least one arm of the doll is mounted for movement on the shoulder of the body for pivotal movement between a first position wherein the hand is adjacent the outer surface of the eye for wiping a tear therefrom and a second position downwardly thereof. Means is provided for manipulating the hand to rotate and a sound generator is mounted internally of the doll to produce a crying sound whenever liquid is forced from the bladder to the surface of the eye.

17 Claims, 4 Drawing Figures

CRYING DOLL

BACKGROUND OF THE INVENTION

1. Field of the Invention

The present invention relates to animated dolls and more particularly to a crying doll wherein tears of liquid are dispensed onto the external surface of the doll's eyes simultaneously with a crying sound produced when the doll is activated. The animated doll also includes a movable arm and hand for wiping away the tears from the doll's eyes.

2. Brief Description of the Prior Art

A wide variety of animated dolls and baby dolls have been developed over the years which provide functions that are similar to those of a real live baby or young child. One such doll is shown in U.S. Pat. No. 4,160,338 wherein the doll is adapted to produce a burping sound when its back is patted and simultaneously to spit up through the mouth some of the water which has previously been fed to the doll from an external bottle.

OBJECTS OF THE INVENTION

It is an object of the present invention to provide a new and improved animated doll of the character described which is manually actuated to produce tears on the external surface of the doll's eyes while simultaneously generating a crying sound.

More particularly, it is an object of the present invention to provide a doll wherein liquid such as water may be introduced into the doll's head through a mouth opening for storage in an internal bladder and subsequently to be ejected in the form of tears appearing on the doll's eyes.

Still another object of the present invention is to provide a new and improved animated doll of the character described having at least one arm which is mounted for manually controlled movement about the shoulder so that a hand on the arm is movable between a first position adjacent the outer surface of the eye for wiping tears from the eyes and a second position downwardly thereof.

Still another object of the present invention is to provide a new and improved animated doll of the character described wherein a movable arm is formed with a hand and means for moving the hand on the arm to closely simulate the action of wiping tears from the doll's eyes.

Still another object of the present invention is to provide a new and improved animated doll of the character described which is manually controlled for developing liquid tears on the external surface of the doll's eyes while at the same time generating a soft crying sound.

Another object of the present invention is to provide a new and improved animated baby doll of the character described which is neat and pleasing in appearance and which closely simulates the real live actions of a young child in crying and wiping tears from the eyes.

SUMMARY OF THE INVENTION

The foregoing and other objects and advantages are accomplished in an illustrated embodiment by way of demonstration and not limitation comprising an animated doll having a hollow body and a hollow head connected at a neck and formed with a face having a pair of eyes and a mouth on the exterior thereof. An internal liquid bladder is mounted in the head having a flexible wall and conduits extending from the bladder to openings formed in the eyes for discharging liquid from the bladder onto the outer surface of the eyes to resemble tears whenever the doll is activated to cry. Means is provided for forcing the liquid from the internal bladder through the conduits to wet the outer surface of the eyes and at the same time a sound of crying is generated. The doll includes at least one arm which is mounted for manually controlled rotation about the doll's shoulder with a hand which is movable relative thereto and is manually controlled to closely simulate the actions of wiping away the tears from the doll's eyes. A filling conduit is provided between the doll's mouth and the internal liquid bladder so that liquid may be injected into the bladder from an external source such as a nursing bottle for subsequent ejection as tears on the doll's eyes whenever the doll is activated to cry.

BRIEF DESCRIPTION OF THE DRAWINGS

For a better understanding of the invention, reference should be had to the following detailed description taken in conjunction with the drawings, in which.

DESCRIPTION OF THE PREFERRED EMBODIMENT

Figure 1:
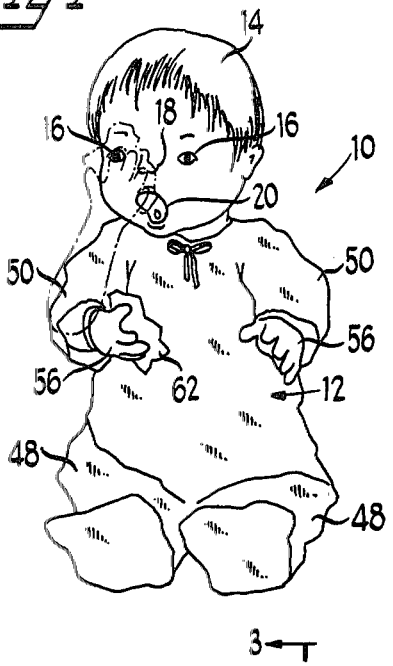
FIG. 1 is a front perspective view of an animated doll constructed in accordance with the present invention.

Referring now more particularly to the drawings, therein is illustrated a new and improved animated crying doll constructed in accordance with the features of the present invention and referred to generally by the reference numeral 10. The doll 10 includes a hollow body 12 and an outer wall preferably formed of thin flexible sheet material such as cloth or plastic. The body provides support for a hollow head 14 preferably formed of thin flexible molded plastic material and the head is formed with a face on the front including a pair of eyes 16, a nose 18 and a mouth 20 shaped to resemble the features of a young child.

Figure 4:
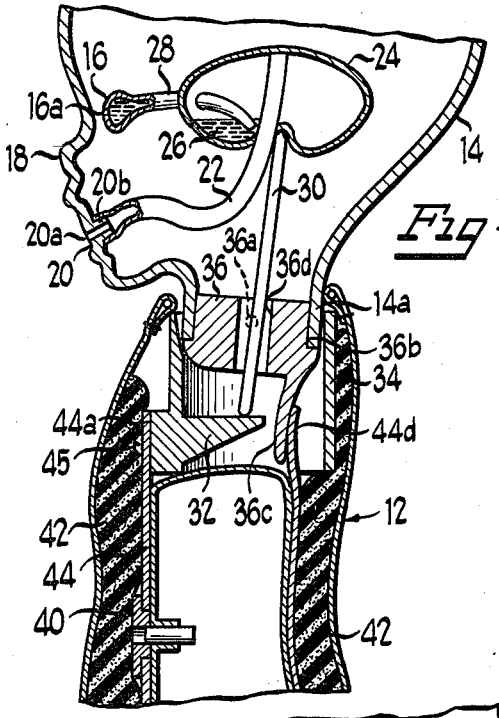
FIG. 4 is a cross-sectional view, similar to FIG. 3, showing the internal components of the animated doll in another operative position.
Figure 3:
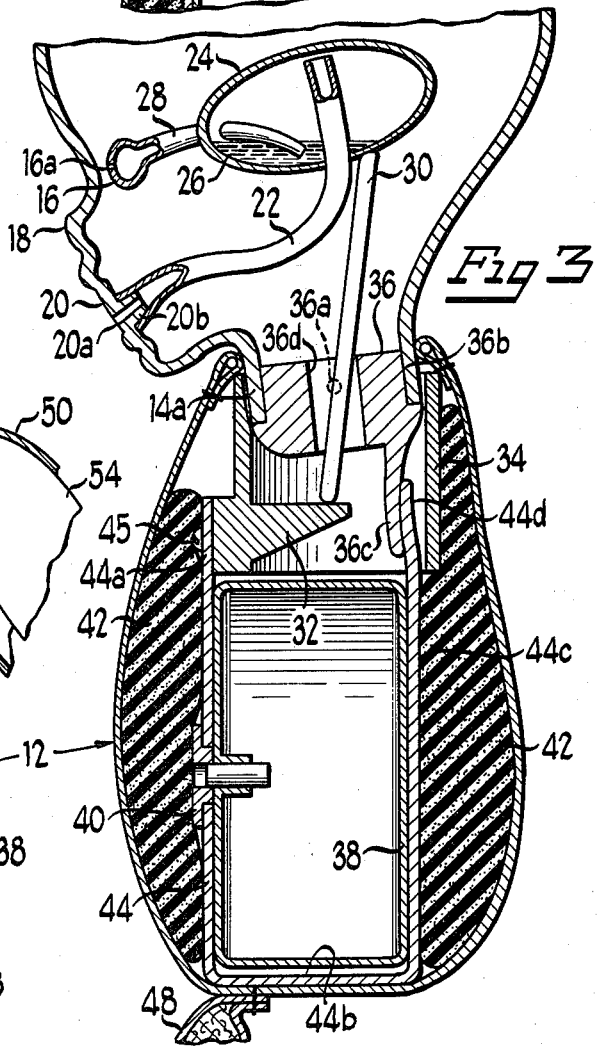
FIG. 3 is a longitudinal cross-sectional view taken substantially along lines 3—3 of FIG. 2.

As indicated in FIGS. 3 and 4, the outer surface of the eyes 16 are segments of spherical shape and including small openings **16*a* at the center adapted for dispensing water on the outer surface of the eyes to resemble tears when the doll is activated to cry. The mouth 20 includes an opening 20*a* adapted to receive the nipple of a simulated nursing bottle, or the like, used for supplying liquid to the doll for crying tears. On the inner surface of the doll's head around the mouth opening 20*a* there is provided an inwardly extending, integral projection 20*b* which is connected to an outer end of a filling tube 22 preferably formed of flexible plastic material and extending upwardly into the interior of an internal liquid bladder 24**.

The liquid bladder is adapted to contain a quantity of liquid 26 supplied through the filling tube from the mouth opening **20*a* when the nipple of a nursing bottle is inserted therein and the bottle is squeezed and compressed. An upper end portion of the filling tube extends upwardly through an opening in the central portion of the bottom wall of the liquid bladder and is open at the upper end so that liquid forced up the tube from the mouth will spill out and collect in the lower end of the liquid bladder. This liquid is subsequently usable to provide tears on the surface of the doll's eyes 16 whenever the flexible wall of the liquid bladder is compressed inwardly tending to decrease the volume thereof. When the bottom wall of the bladder is urged upwardly, the upper end of the filling tube is closed off by the upper wall of the bladder as shown in FIG. 4 and the liquid 26 in the lower portion of the bladder is then forced outwardly by air pressure in the bladder through a pair of conduits or tear ducts 28 connected between the eye openings 16***a* at the outer end and inner end portions extending into the liquid bladder. These inner end portions are formed with downwardly curved segments open at the lower end in order to receive liquid 26 which is forced upwardly through the ducts and out onto the surface of the eyes through the openings 16*a* when the walls of the liquid bladder are compressed inwardly to pressurize the air therein.

Figure 2:
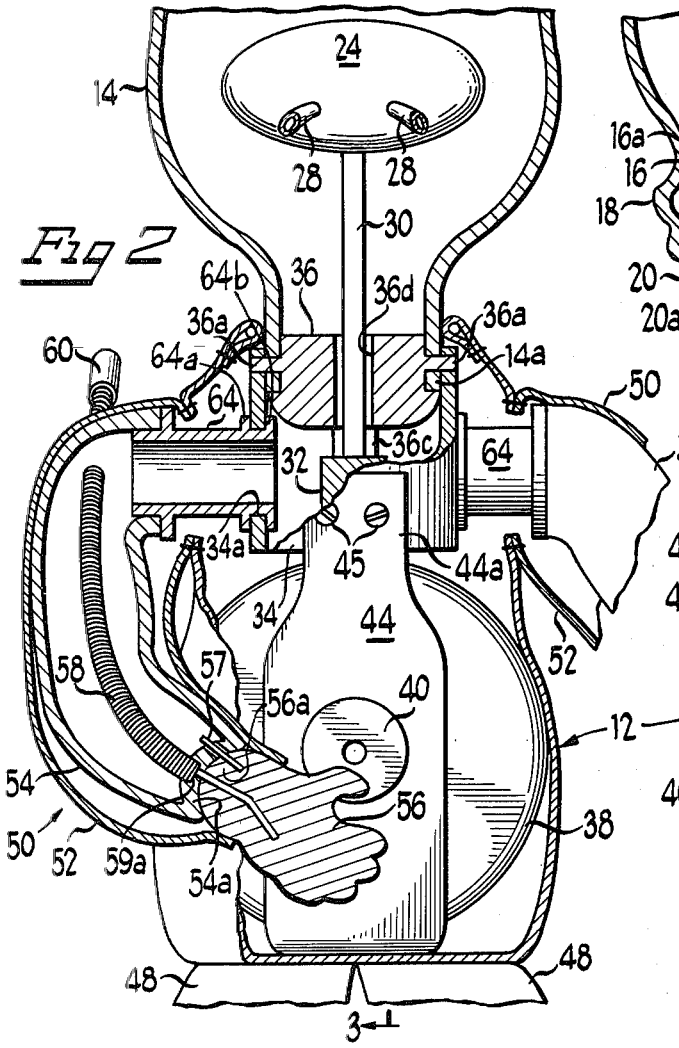
FIG. 2 is an enlarged, cross-sectional view taken laterally through the doll's head and body showing internal components therein.

The liquid bladder 24 is supported in part by the inner end portions of the filling duct 22 and the tear ducts 28 and the lower wall portion thereof rests on the rounded upper end of a central support post 30 which projects upwardly from a base bracket 32 mounted internally of the body 12 adjacent an upper shoulder portion thereof. The bracket 32 is integrally formed on a hollow tubular internal neck connector 34 preferably formed of stiff or rigid molded plastic material and open at the upper end in order to receive an annular head supporting internal neck element or collar 36 also preferably formed of stiff or rigid plastic material and mounted for rocking movement in the upper end portion of the neck connector on a pair of laterally outwardly extending, integrally formed, pivot pins 36*a* which are journalled in circular openings provided in opposite sides of the neck connector as shown in FIGS. 2, 3 and 4.

The internal collar 36 is formed with an annular shoulder 36*b* around the exterior upper portion thereof in order to receive and support a downwardly extending neck portion 14*a* of the doll's head 14. As indicated in FIGS. 3 and 4, the doll's head is rockable back and forth about a lateral axis extending through the pivot pins 36*a* between a forward position as shown in FIG. 3 and a rearward position as shown in FIG. 4 wherein a central portion of the lower wall of the liquid bladder 24 is depressed upwardly by the rounded upper end of the support post 30. When this occurs, the upper end of the filling tube 22 is closed off by the upper wall of the bladder and the entrapped air pressure within the liquid bladder forces the liquid 26 outwardly through the tear ducts 28 to form tears on the surface of the eyes 16. The collar includes a central passage 36*d* for loosely guiding the support post 30 which extends upwardly through the passage from a rounded lower end which rests on the flat upper surface of the bracket 32. The passage 36*d* has a circular transverse cross-section somewhat greater in diameter than the transverse diameter of the support post and accordingly the support post is freely movable within the passage to a limited extent while maintained in a generally upright orientation.

When the head 14 is rocked forwardly to the position of FIG. 3, the upward pressure on the lower wall of the liquid bladder 24 from the support post 30 is relieved and the upper wall of the liquid bladder moves upwardly away from the open upper end of the filling tube 22 so that air pressure may again be equalized between the interior of the bladder and the atmosphere.

In order to rock the doll's head back and forth to produce tears on the surface of the eyes 16, a generally cylindrical, pneumatic chamber 38 having a wall of thin flexible plastic material is mounted in the lower portion of the doll's body 12 beneath the neck connector 34. On a forward wall of the pneumatic chamber there is mounted a pneumatic whistle 40 which produces a soft crying sound whenever the walls of the chamber are compressed to expel air outwardly through the whistle by pressure applied to the abdomen of the doll's body 12. Pads of cellular type foam filler material 42 are provided on the front and back side of the pneumatic chamber to help form and shape the doll's body.

The air chamber 38 is supported in a U-shaped element 44 preferably formed of relatively stiff molded plastic material and having a front leg 44*a* secured at its upper end to a forward face of the neck connector 34 by suitable fasteners 45. The chamber support includes a lower bight portion 44*b* and a flexible rear leg 44*c* having an upper end portion 44*d* projecting upwardly above the air chamber 38 into the hollow interior of the neck connector 34 as shown in FIGS. 3 and 4.

The upper end portion 44*d* is adapted to forcibly engage a downwardly extending tongue 36*c* on the annular collar 36 in the neck 14*a* of the head so that whenever the body of the doll is squeezed by pressure applied from the front and back sides of the abdomen, the end portion 44*d* moves the tongue 36 forward causing the head to tilt back as shown in FIG. 4. When the squeezing pressure on the abdomen is subsequently relieved, the head bobs back to the forward position of FIG. 3 as the back wall of the pneumatic chamber 38 returns to its normal position in response to the internal pressure generated within the chamber 38 by the squeezing of the abdomen. Upon release of the abdomen, the chamber 38 returns to its original position, shown in FIG. 3, pushing outwardly on portion 44*d* and allowing the head 14 to rotate back to its natural, unactuated position by gravity. From the foregoing it will be seen that squeezing of the doll's abdomen results in liquid tears appearing on the surface of the eyes 16 and at the same time a crying sound is generated by the expulsion of air from the chamber 38 through the whistle 40 mounted on the forward wall thereof.

The doll 10 includes a pair of legs 48 secured to the lower end of the body 12 as shown in FIG. 3 and a pair of movable arms 50 are mounted for rotation about a transverse axis extending through the shoulder of the body. The arms are manually controlled for movement between a lower position (FIG. 2) and an upper position shown in dotted lines. As shown in FIG. 2, each arm 50 includes an outer wall or skin 52 of flexible cloth or plastic sewed at the upper end to the cover or skin of the doll's body. The skin encloses or covers a hollow tubular internal arm member 54 preferably formed of thin molded plastic material.

At the lower end, each arm is provided with a separate hand 56, preferably formed of molded plastic material and secured on the lower end portion of a flexible shaft 58. The shaft extends through the arm member 54 and is provided with a control knob 60 on an upper end portion extending outwardly of the arm at the shoulder portion and to the rear as shown in FIG. 2.

At the lower end, each arm member 54 is formed with a concave, socket-like end wall 54*a* having a hemispherically shaped surface for guiding contact with spherically surfaced ball-like portion 56a on the wrist or upper end portion of the hand 56. The ball and socket joint or connection between the arm member and hand permits the hand to be rotated back and forth from a neutral position which is maintained by a wire spring element 57 which has a lower end embedded in the ball 56a of the hand and an upper end portion which projects upwardly through an aperture of slightly larger diameter formed in the socket wall 54a of the arm member as shown in FIG. 2. The spring element always returns the hand to central or neutral rotative position relative to the arm member after the control knob 60 is released yet does not greatly interfere with rotative movements of the hand on the arm controlled by rotation of the knob 60 on the upper end of the flexible shaft 58.

The hands 56 are adapted to hold a handkerchief 62 used for wiping tears from the eyes 16 when the arm is in the elevated position with the hands positioned adjacent the surface of the eyes. Rotation of the control knob 60 on the flexible shaft 58 rotates the hands 56 on the arms 45 to facilitate wiping tears from the eyes.

At the upper end, each internal arm 54 is secured to the outer end of a rotatable hollow sleeve 64 having a pair of spaced apart outwardly extending annular flanges 64a and 64b on the inner end. These flanges guide and retain the sleeve 64 for free rotation in enlarged side openings 34a provided on opposite sides of the neck connector 34. Each arm 50 is manually pivotable about a lateral axis extending through the shoulder of the body to move the hands 56 from a lower position to an upper position adjacent the eyes 16. The hands 56 may be individually rotated on the arms by the control knobs 6 of the flexible shafts 58 to closely simulate the wiping of tears from the eyes.

Although the present invention has been described with reference to a single illustrated embodiment thereof, it should be understood that numerous other modifications and embodiments can be devised by those skilled in the art that will fall within the spirit and scope of the principals of this invention.

What is claimed as new and desired to be secured by Letters Patent of the United States is:

1. An animated doll, comprising:

a hollow body with a hollow head connected at a neck and formed with a face having hair, eyes and a mouth;

a bladder for containing liquid in said head having a flexible wall and conduits in communication between said bladder and openings formed in said eyes for conducting liquid from said bladder to the outer surface of said eyes;

means for forcing liquid from said bladder through said conduit to said outer surface of said eyes;

at least one arm including a hand at the outer end, said hand including means for holding a handkerchief and said arm mounted for movement on said body about an axis adjacent a shoulder portion between a first position wherein said hand is adjacent the outer surface of said eye and a second position downwardly therefrom, and means on said doll remote from said hand for manually controlling rotation of said hand relative to said arm about an axis extending longitudinally of an adjacent portion of said arm.

2. The animated doll of claim 1 wherein said means for manually rotating said hand on said arm includes shaft means having a handle portion for turning the same adjacent said shoulder of said arm.

3. The animated doll of claim 1 including liquid filling tube means extending between an exterior opening in said mouth and said bladder for introducing liquid into said bladder.

4. The animated doll of claim 3 including check valve means for preventing liquid from flowing out of said bladder toward said exterior opening of said mouth.

5. The animated doll of claim 4 wherein said check valve means comprises a wall portion of said bladder normally engaging an open end of said filling tube means extending upwardly inside said bladder.

6. The animated doll of claim 5 wherein said means for forcing liquid from said bladder is operative to elevate said wall portion of said bladder away from said open end of said filling tube means permitting external air to enter said bladder from said mouth opening.

7. The animated doll of claim 1 wherein said conduits between said bladder and said eye openings include downwardly curved inner end portions in said bladder having open ends for receiving liquid therefrom to move toward said eyes.

8. The animated doll of claim 1 or 7 wherein said means for forcing liquid from said bladder to said eyes includes means for deflecting a wall portion of said bladder inwardly.

9. The animated doll of claim 8 wherein said means for forcing liquid includes operator means in said body including a wall movable inwardly thereon.

10. The animated doll of claim 9 including means for producing a crying sound when said liquid is forced toward said eye openings.

11. The animated doll of claim 10 wherein said means for forcing liquid includes a flexible air chamber in said body and said means for producing a crying sound includes whistle means activated by inward flexing of a wall of said air chamber.

12. The animated doll of claim 9 wherein said operator means includes means for tilting said head on said body to flex said wall of said bladder as said head tilts.

13. The animated doll of claim 12 wherein said tilting means includes a post extending upwardly of said body through said neck having an upper end engaging a lower wall portion of said bladder.

14. The animated doll of claim 12 wherein said tilting means includes a pair of members within said body relatively movable with respect to one another and a flexible chamber sandwiched between said members, one of said members connected to said head for producing said tilting motion of said head in response to relative movement of said members and said chamber including whistle means for producing a crying sound when said chamber is flexed by relative motion between said members.

15. An animated doll, comprising:

a hollow body with a hollow head connected at a neck and formed with a face having a pair of eyes and a mouth;

a bladder for containing liquid in said head having a flexible wall and conduits in communication between said bladder and openings formed in said eyes for conducting liquid from said bladder to the outer surface of said eyes; and means for forcing liquid from said bladder through said conduit to said outer surface of said eyes, said means including manually actuable means located within said hollow body for simultaneously forcing liquid from said bladder and causing said head to tilt with respect to said body; said tilting means including a pair of relatively movable members located within said hollow body, one of said members being connected to said head to cause said tilting movement of said head, said tilting means including a flexible-walled chamber located within said body between said members, said chamber operative to return said members to their original positions after relative movement of said members with respect to one another.

16. The animated doll of claim 1 including whistle means in communication with said chamber for producing a crying sound when said members are moved with respect to one another.

17. The animated doll of claim 1 wherein said members are manually actuable from a position remote from said head.

* * * * *